US007070076B2

(12) United States Patent
Bergkvist

(10) Patent No.: US 7,070,076 B2
(45) Date of Patent: Jul. 4, 2006

(54) CHILD-SUPPORTING SHOULDER HARNESS

(75) Inventor: Håkan Bergkvist, Bromma (SE)

(73) Assignee: Baby Bjorn AB, Danderyd (SE)

( * ) Notice: Subject to any disclaimer, the term of this patent is extended or adjusted under 35 U.S.C. 154(b) by 411 days.

(21) Appl. No.: 10/398,211

(22) PCT Filed: Jun. 18, 2002

(86) PCT No.: PCT/SE02/01176

§ 371 (c)(1),
(2), (4) Date: Apr. 8, 2003

(87) PCT Pub. No.: WO03/003880

PCT Pub. Date: Jan. 16, 2003

(65) Prior Publication Data

US 2004/0020951 A1 Feb. 5, 2004

(51) Int. Cl.
*A51G 1/00* (2006.01)

(52) U.S. Cl. ..... 224/160; 224/646

(58) Field of Classification Search ..... 224/160, 224/159, 158, 646
See application file for complete search history.

(56) References Cited

U.S. PATENT DOCUMENTS

| | | | | |
|---|---|---|---|---|
| 5,678,739 | A * | 10/1997 | Darling et al. | 224/160 |
| 5,813,580 | A * | 9/1998 | Fair | 224/160 |
| 5,819,341 | A * | 10/1998 | Simantob et al. | 5/98.1 |
| 6,415,969 | B1 * | 7/2002 | Higuchi | 224/160 |
| 6,443,339 | B1 * | 9/2002 | Higuchi | 224/160 |
| 6,598,771 | B1 * | 7/2003 | Norman | 224/160 |
| 6,736,299 | B1 * | 5/2004 | Bergkvist | 224/160 |
| 6,866,174 | B1 * | 3/2005 | Hiscocks | 224/160 |

FOREIGN PATENT DOCUMENTS

| | | |
|---|---|---|
| SE | 516 108 | 11/2001 |
| WO | 01/84984 | 11/2001 |

* cited by examiner

*Primary Examiner*—Stephen K. Cronin
(74) *Attorney, Agent, or Firm*—Jacobson Holman PLLC

(57) ABSTRACT

A child-supporting shoulder harness includes a flexible front piece which is connected in the harness to form a child-supporting pouch. The front piece includes a length-adjustable connecting device which extends between two horizontal, mutually spaced points on the front piece, so as to enable the width of the pouch to be varied. When the width is reduced, the lateral end-parts of the front piece are deformed in a way that reduces the wedging action between the wearer's chest and the baby's head and provides a comfortable lateral head support for a sleeping baby.

20 Claims, 4 Drawing Sheets

CHILD-SUPPORTING SHOULDER HARNESS

This is a nationalization of PCT/SE02/01176 filed Jun. 13, 2002 and published in English.

BACKGROUND OF THE INVENTION

1. Field of the Invention

The present invention relates to a child-supporting shoulder harness of the kind having a harness arrangement that includes chest straps and a front piece, the front piece being flexible at least in its upper portion, and the lower portion of the front piece being connected to the lower part of the harness and connected at its laterally separated side edges with the chest straps so as to form a child-carrying pouch.

2. Description of the Related Art

The invention thus relates to a child-supporting shoulder harness of the kind disclosed in, for example, SE 0001700-4, i.e. a harness of the kind that includes, among other things, chest straps that are situated on the front side of the wearer, a front piece which is flexible at least in its upper portion and the lower portion of which is connected with the harness and the side edges of which are connected to the chest straps such as to form a child-supporting pouch that includes leg openings.

An upper lateral part of the upper edge portion of the front piece may be buckled to an adjacent part of an adjacent chest strap, wherein the buckle, or coupling, includes a first buckle part which is connected to the front piece, and a second buckle part which is connected to the chest strap. The upper edge portion can be used as a head support for a small child or infant. Alternatively, the upper edge portion may be used as an upwardly extended backrest for a larger child. Releasable buckle devices can connect the side edges of the front piece to adjacent positions on adjacent chest straps such as to form the actual pouch, wherein the buckle devices are located at a level beneath the couplings.

SUMMARY OF THE INVENTION

One object of the present invention is to provide means for enabling the width of the front piece to be changed locally in a horizontal direction, such as to adjust the free perimeter of the pouch opening that receives the child, for instance with regard to the size of the child and/or the thickness of the clothing worn by the child, and/or to change the shape of part of the front piece so as to provide a comfortable child support. A further object is to provide such a change without needing to influence the supportive safety of the harness whilst a child is carried in the pouch. A further object is to provide for comfortable and continuous change in the effective width of the front piece.

Still a further object of the invention is to provide a coupling, or buckling arrangement, which is well-adapted to the devices for changing the local width of the front piece and which can be manoeuvred comfortably and safely with one hand.

A further object is to provide a coupling with which the upper edge portion of the front piece is held stably at respective chest straps in the upwardly folded state or in the downwardly folded state of the front piece, particularly when the front piece is springily elastic.

These objects are achieved either totally or partially by means of the invention.

The invention is directed to a child-supporting shoulder harness having a harness arrangement that includes chest straps and a front piece, the front piece being flexible at least in its upper portion, and the lower portion of the front piece being connected to the lower part of the harness and connected at its laterally separated side edges with the chest straps so as to form a child-carrying pouch. A connecting device of selectively adjustable length has a first end-part and a second end-part that are connected to the front piece at positions that are mutually spaced laterally and that have a substantial mutual distance. The connecting device also includes an adjustment fitting which enables the effective distance between the two end-parts to be set selectively.

Further embodiments of the invention include a harness arrangement in which the connecting device includes a pull strap which extends through the adjustment fitting, and a releasable coupling or buckle connecting a lateral end-part of an upper edge portion of the front piece to an adjacent part of the adjacent chest strap in a position above an attachment device that connects respective chest straps to an adjacent side edge of the front piece. The lateral end-parts of the front piece can have a fold line that extends generally vertically between the end-parts of the connecting device.

According to further preferred embodiments, the coupling arrangement can be manuevered with one hand and includes two coupling parts of which a first coupling part is connected to the front piece and is connectable to its associated second coupling part in two positions of rotation about a generally horizontal axis in the plane of the front piece, these positions being mutually separated through 180°. In addition, the upper edge region of the front piece can be folded about a generally horizontal fold line, and the coupling part connected to the front piece is situated in a position in the proximity of the fold line in the flat-lain state of the front piece. The first coupling part connected to the front piece may include a ring-shaped body, the second coupling part co-acting with the first coupling part including a post which projects forwards essentially at right angles to the plane of the chest strap and has a latching waist. The ring-shaped body has latching elements which are spring-biased into engagement with mutually opposite sides of the waist when the coupling has been established. The ring-shaped body can be coupled to the post in both of its positions of rotation in which its major surfaces are parallel with the surface of the adjacent chest strap.

According to still further embodiments, the free end of the post is conical so that it will function to move the latching element of the first coupling part as a result of the wedging effect obtained when threading the first coupling part onto the post. The latching elements carry press keys which project out from the first coupling element in diametrically opposite directions so as to allow the latching elements to be moved out of their co-action with the waist on the post when the keys are subjected to pressure in mutually opposite directions.

Each of the lateral end-portions of the upper edge region of the front piece can be connected to the adjacent chest strap through the medium of a respective coupling or buckle arrangement. The length-adjustable connecting device is fitted in connection with the coupling part located on the front piece.

In addition, the first coupling part can be rotatable about its associated post, and can be located in the proximity of the generally horizontal fold line for the upper edge region of the front piece. The connecting device may be located at a central part of the front piece on the level of the attachment devices. Further, the connecting device can be connected to a lateral portion of the front piece at its attachment device.

An important feature of the invention is that a connecting device whose length is selectively adjustable as a first end-part and a second end-part, said end-parts being connected to the front piece at substantial distances apart in the horizontal direction.

The greatest length of the connecting device is at least equal to the distance along the surface of the front piece between the anchoring points of respective ends of said device. The connecting device suitably includes a line or strap that runs through a lock or latch fitting, wherein the latch fitting forms one of the end-parts of said connecting device. The fitting is of a well-known nature and includes a strap opening that has a strap deflecting rod, and an opening-defining edge that has a braking effect on a strap part, and wherein the strap is able to slide through the fitting by dropping said fitting around its post, so that the gripping edge of the fitting passes free from the strap. The strap part that extends out through the fitting may have a finger grip which facilitates gripping of said strap end with one hand and which prevents the strap from being drawn free from the fitting. The connecting device is preferably situated on the outwardly exposed side of the front piece. The front piece may typically include lateral apertures or openings in the region of a horizontal fold line for an upper edge portion of the front piece, said edge portion being located above the upper edge of the actual pouch and can be used, e.g., to support the head of the child by virtue of the lateral ends of the upper edge portion being connected to the chest straps, for instance by means of releasable couplings or buckle arrangements.

In one particularly preferred embodiment of the invention, the coupling is of the known kind that includes a ring-shaped body and a post that co-acts with said body. The post has a waist and the ring-shaped body has a latch element which is spring-biased in a latching position in which it engages the waist, and which can be actuated manually by press keys exposed on the body, such as to release the latch element from the waist. The free end of the post may be bevelled to provide a wedging effect, so that the latch element will be returned against the action of its spring bias as the ring-shaped body is threaded onto the post.

The use of such a coupling, particularly between the lateral ends of the upper portion of the front piece and the chest straps of the harness in respect of a child-supporting shoulder harness such that the post will project forwards on the outside of the chest strap results in a number of advantages that are significant with respect to such a shoulder harness, namely that:

- The ability of the ring-shaped body to rotate about the post facilitates the coupling operation and minimises the stresses in the coupling and in those parts of the harness connected by said coupling.
- The shape-bound latching of the ring-shaped body to the post affords a considerable degree of safety, which is particularly important in the case of a harness of this nature.
- The ring-shaped body can be rotated through 180° about a horizontal ring diameter and can be coupled to the post with equal security in both of its positions of rotation, which is a favourable feature in view of the fact that the upper pivotal portion of the front piece should be capable of being coupled to the chest strap in both pivoted positions of the upper edge portion.
- The ring-shaped body is non-rotationally connected to the post with regard to rotation about a horizontal axis in the plane of the front piece, which is an important feature when the ring-shaped body is, in turn, non-rotationally connected to the upper and springily elastic pivotal edge portion of the front piece, since such non-rotatability contributes towards holding the upper edge portion of the front piece in its downwardly pivoted position, despite the tendency of said upper edge portion to lift elastically.
- The user is able to establish the coupling readily with one hand, particularly by placing the thumb of the adjacent hand behind the chest strap and beneath the post, while pressing the ring down over the post with the index finger and long finger of the same hand.
- The user can readily open the coupling, by manipulating the mutually opposite latchkeys of the ring-shaped body with the thumb and index finger of the adjacent hand.
- The coupling emits a clear acoustic signal indicating that the coupling is locked, when the latch element of the ring-shaped body snaps into the waist on the post under said spring bias, whereas the coupling can be released with no noise or only a slight noise.
- The coupling can be designed so that the latch element of the ring-shaped body will snap into the waist on the post, essentially when the ring-shaped body comes into contact with an abutment at the bottom of the post in both of the orientations of the ring-shaped body on the post, said orientations being separated by 180°.

BRIEF DESCRIPTION OF THE DRAWINGS

The invention will now be described by way of example and with reference to the accompanying drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
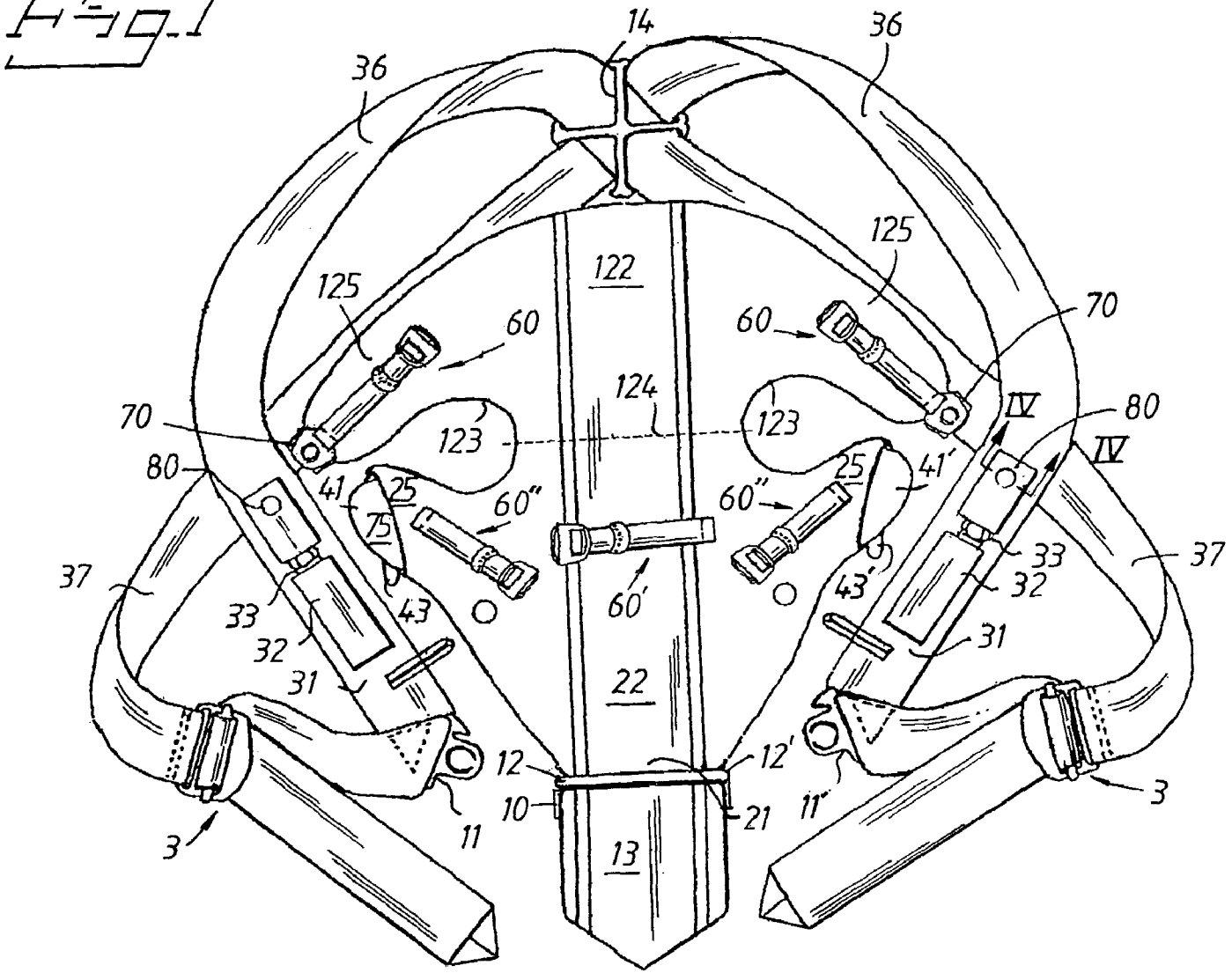
FIG. 1 is a schematic illustration of an inventive child-supporting shoulder harness.

FIG. 1 illustrates a child-supporting shoulder harness that includes two chest straps 31 which are intended to extend generally vertically on a respective side of the wearer's chest. Each strap 31 extends over a respective shoulder of the wearer, with the straps crossing each other on the wearer's back. A fitting 14 is shown to hold together the strap parts 36 that cross each other on the wearer's back, these strap parts extending with a strap portion 37 around the wearer's hip after the strap intersection point 14, and connects to a coupling fitting 11, 11' to which the lower portion of the chest strap 31 also connects.

The strap portion 37 will suitably include an adjustment device 3, which enables the length of said strap portion to be readily adjusted.

The coupling devices 11, 11' can be releasably connected to corresponding coupling devices 12, 12' in a holder 10 which by means of an adjustement buckle 13 receives, in a length adjustable fashion, a band-formed central lower portion 21 of a front piece 22. The front piece 22 may consist of a flexible fabric or corresponding material whose lower portion has a generally triangular shape, wherewith the upper corners 25 of the triangle are each provided with a respective connector 41, 41' which is comprised generally of a long downwardly extending finger 43 that can be received in a pocket 32 of corresponding depth on the front strap 31, via the upwardly facing inlet opening 33 of said pocket, such that the front piece will form a safe child supporting pouch.

The front piece 22 also includes an upper edge portion 122, which can be lowered onto and raised from the lower portion of the front piece 22 about a fold line 124. The front piece 22 has lateral apertures or openings 123 on the level of the fold line 124.

Formed in the region between the fittings 12, 75; 12', 75' between the chest strap 31 on the one hand and the front piece 22 on the other hand is an opening for the child's legs. The upper edge portion 122 can be dropped down when the child is awake. When a child wishes to rest or to sleep, the upper edge portion 122 can be raised and its lateral ends 125 connected to adjacent parts of the chest straps 31 with the aid of a releasable coupling or buckle arrangement that includes a part 70 which is connected to the top of the part 125 and another part 80 of said arrangement is connected to the strap 31.

The edge portion 122 is flexible, at least at the lateral end-parts 125 thereof and with respect to folding of said part about the fold line 124. The coupling or buckle arrangement 70, 80 co-acts with the edge portion 122 so that said edge portion will form a support for the head of a small child and/or a sleeping child.

Figure 2:
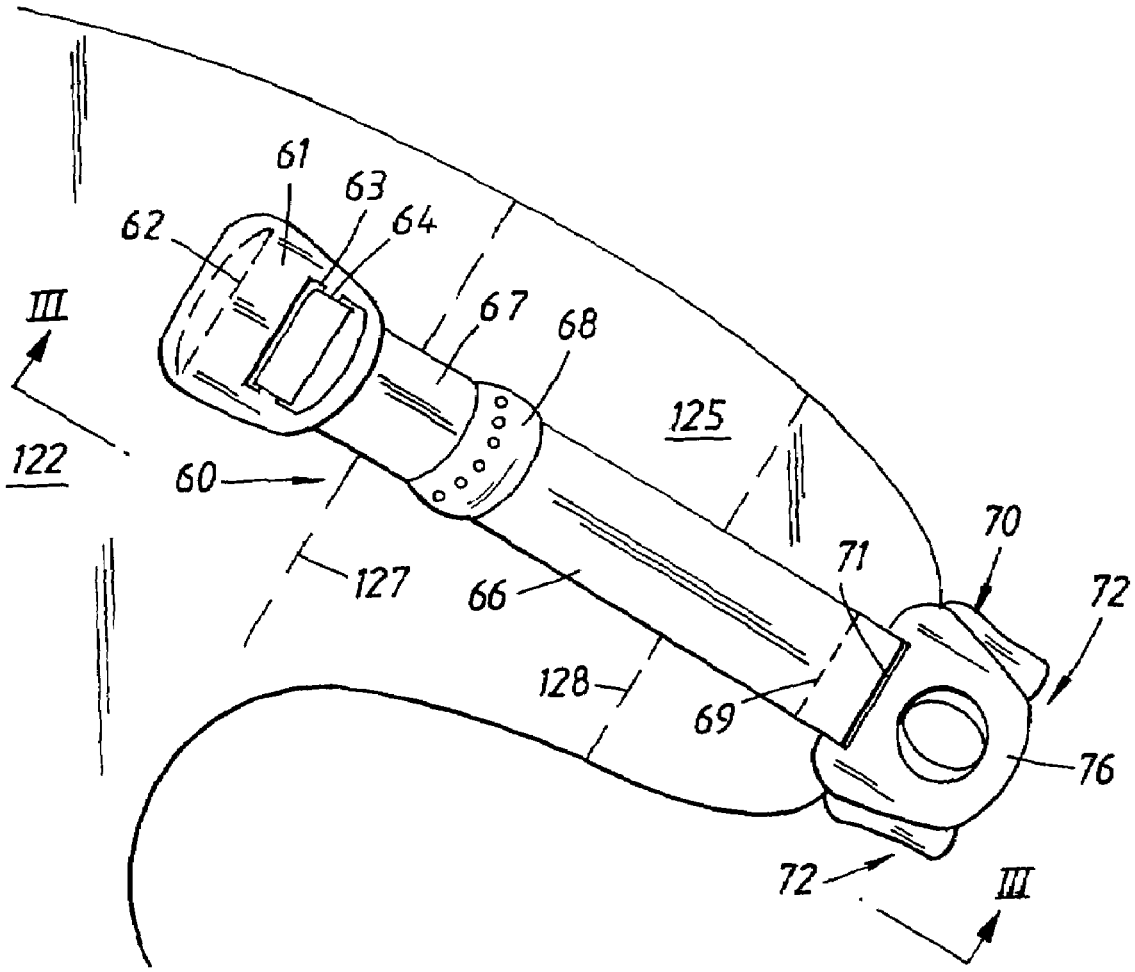
FIG. 2 is a view of a connecting device taken from the harness shown in FIG. 1, and also shows a part of a coupling arrangement, or buckle arrangement, for connecting the upper edge portion of the front piece to a chest strap included in the harness.

FIG. 2 shows that the first part 70 of the buckle arrangement is non-rotatably connected to the lateral apex portion 125 of the part 70, wherewith the seam 69 suitably extends through both portions of the end-part of the belt 66 and the front piece.

Roughly midway of the symmetry line of the front piece 22 is an anchor fitting 61 which is connected to the part 122 by means of a seam 62. The fitting 61 has two through-penetrating openings that are delimited from one another by a post 64. The free end-part of the strap 66 extends through the openings 63 and around the post. The free end 67 of the strap includes a finger grip 68, which also functions to prevent withdrawal of the strap through the openings in the fitting 62. The fitting 62 co-acts with the strap 66 in a well-known manner, wherewith the effective length of the strap 66 between the post 64 and the seam 69 can be adjusted by manipulation of the strap end 67 and raising the fitting 61 around the seam 62 so as to enable the strap 66 to slide out of the fitting 61.

The strap 66 is orientated generally horizontally.

Figure 3:
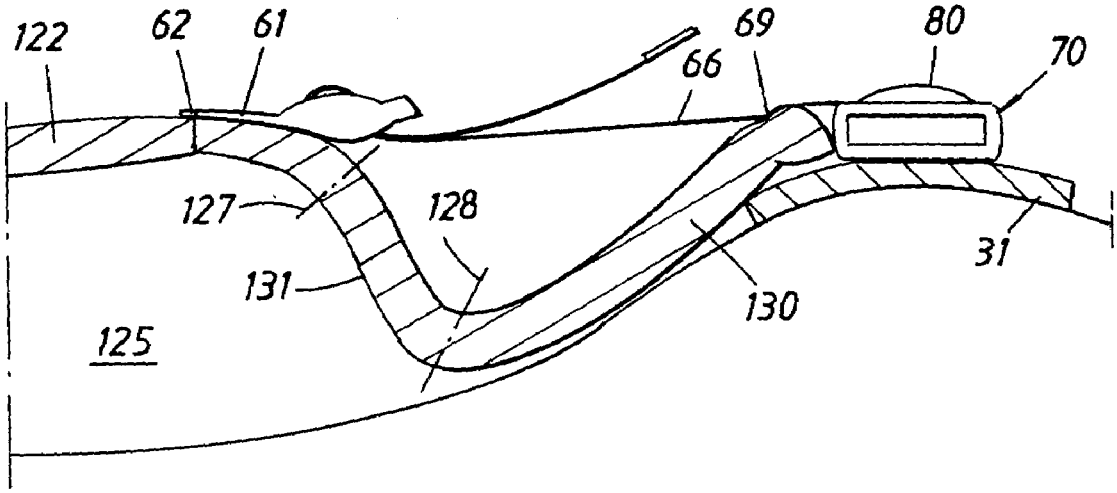
FIG. 3 is a schematic view taken on the line III—III in FIG. 2, and shows the first coupling part coupled to a further coupling part on the harness chest strap.

It will be seen from FIG. 3 that the strap arrangement 60 enables selective adjustment of the distance between the buckle part 70 and the fitting 61, and that the part 125 will bend naturally in the configuration shown in FIG. 3, partly around a generally vertical fold line in the proximity of the seam and partly in a longitudinal centre portion 128. The part 130 between the seam 69 and the fold 128 lies against the wearer's chest, and the part 131 between the fold lines 127, 128 retains a generally flat state whose angle to the wearer's chest varies with the effective length of the strap 66. The part 131 forms a comfortable support surface for the child's head.

As will be understood, bend indications/fold lines 127, 128 may be provided in the front piece, so as to ensure that the front piece will bend at the places indicated.

It will be seen that the strap arrangement 60 can be reached and manoeuvred even when the upper edge portion 122 is folded down against the lower portion of the front piece 22, so as to enable the size of the upwardly facing opening of the pouch to be adjusted if so desired.

According to one particularly preferred embodiment of the invention, the part 70 of the coupling or buckle is of the known kind that includes a ring-shaped flat coupling element 70 which is connected releasably by threading said element onto a post 80.

This arrangement enables the coupling part 70 to be connected to the post 80 in either of two rotational positions that are separated by 180° around a rotational axis corresponding to a generally horizontal diameter through the opening in the coupling part 70. The coupling part 70 is fitted so as to lie in the proximity of the fold line 125 through the flat-lain front piece 22. Because the coupling part 70 is non-rotatably connected to the apex portion 125, the coupling or buckle arrangement 70, 80 contributes towards keeping the edge portion 122 downwardly folded about the line 124. The flexible, springy elastic front piece 22 has a tendency to allow the upper edge portion 122 to remain in the raised state shown in FIG. 1, under the influence of its own springiness.

Figure 5:
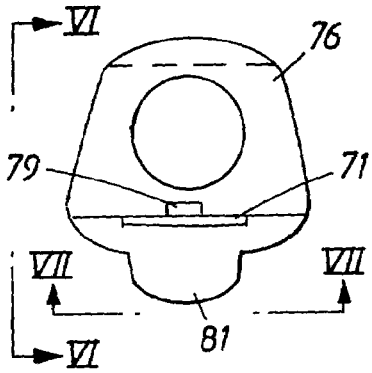
FIG. 5 is a side view of a housing for the first coupling part.
Figure 6:
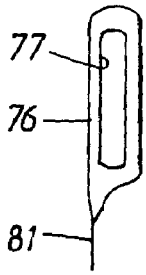
FIG. 6 is a view taken on the line VI—VI in FIG. 5.
Figure 7:
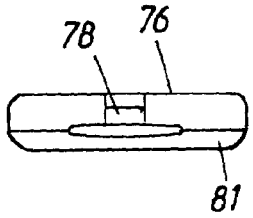
FIG. 7 is a view taken on the line VII—VII in FIG. 5.
Figure 8:
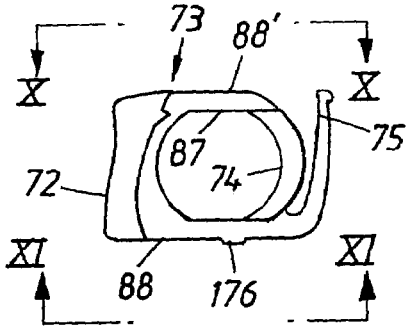
FIGS. 8 and 9 are opposite plan views of a carrier element in the first coupling part.
Figure 9:
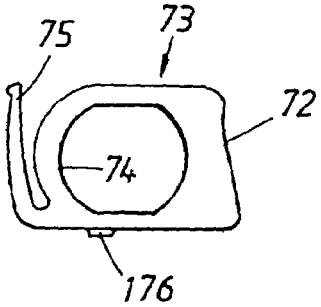
Figure 10:
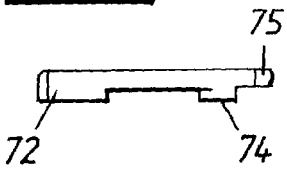
FIGS. 10 and 11 are views taken on respective lines X and XI in FIG. 8.
Figure 11:
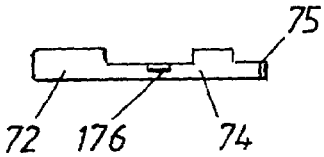
Figure 12:
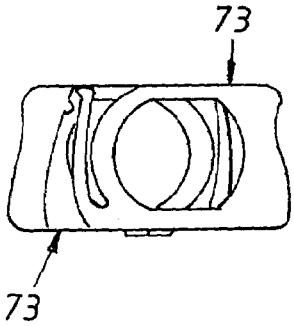
FIG. 12 shows two carrier elements according to FIGS. 8–11, said elements being brought together prior to their insertion into the housing shown in FIGS. 5–7.

In one particularly preferred embodiment of the coupling part 70, said part comprises a generally tubular housing 76 in accordance with FIGS. 5–7, which receives two mutually identical carrier elements 73, in accordance with FIGS. 8–11, which are brought together to a configuration according to FIG. 11 prior to the pair of latch elements 73 being inserted into the housing 76 to form the completed coupling part 70 as shown in FIG. 2.

Each element 73 has the general form of a thin flat plate or disc that includes an opening 87 and two generally parallel and mutually opposite edges 88, 88'. The plate is widened, at 72, between the opposite sides of the opening 27, so as to form respectively a press key 72 and a latch edge 74 that provides a boundary of the opening 87. The element also includes a spring leg 75 that lies in the plane of the plate and extends generally perpendicularly out from one edge 88 in a direction towards the other edge 88'.

The element 73 can be assumed to be comprised of a springy elastic material, for instance a plastic material.

Latch shoulders 176 project out from the edge 88.

Provided in the bottom of the housing 76 adjacent its slot 71 is a wall opening 79 which receives the latch shoulders 176 when the pair of elements 73 are inserted into the through-penetrating channel 77 of the housing 76 in the configuration shown in FIG. 11.

The post 80 includes a relatively wide bottom plate 83 that forms a stop abutment for one main surface of the coupling part 70 as the coupling part 72 is threaded onto the post 80. The post 80 is suitably rotationally symmetrical about an axis which is perpendicular to the plane of the chest strap 31, and the post 80 includes a waist 82 and a conical free end 81 that can co-act with the carrier wedges 78 in a manner to move them apart.

The waist 82 is delimited by two parallel ring surfaces. As the coupling part 70 is threaded down on the post 80, the wedges 78 will audibly snap into the waist 82 and provide a shape-binding facility against withdrawal of said coupling part. The latch shoulders 74 of the coupling part are released from the waist, by pressing the two exposed press keys 72 simultaneously towards each other and into the housing channel, for instance with the thumb and index finger of the manoeuvring hand. The ring-shaped coupling or buckle part 70 can be pressed onto the post simply by pressing down said coupling part 70 on the post. The certainty that the coupling part 70 is in latching engagement with the waist 80 on the post and has been moved down the post to a full extent is enhanced by the stop abutment 83 and its distance from the waist 32.

Figure 4:
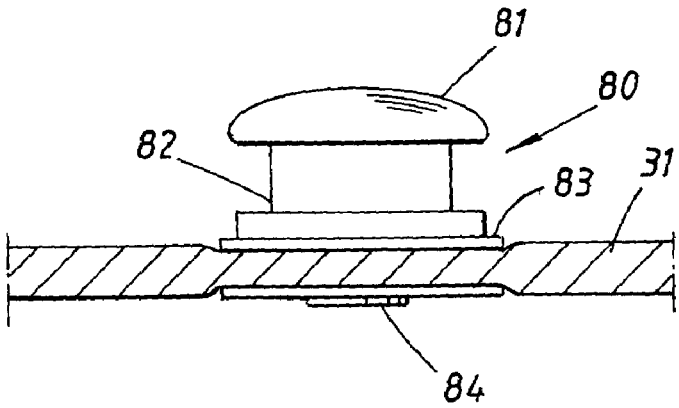
FIG. 4 is a schematic side view of the second part of the coupling arrangement.

It will be seen from FIG. 4 that the post 80 is anchored to the strap 31 by means of a rivet plate 84.

FIG. 1 shows a central, horizontal strap arrangement 60' on the level of the hook fittings 41, 41', i.e. on the level of the actual upper edge of the pouch. The strap arrangement 60' provides a selectable setting of the effective opening perimeter of the pouch on this level.

Alternatively, or additionally, a strap arrangement 60" may be provided on one or both sides of the front piece on this level, wherewith the strap arrangement 60" may be connected at one end to respective hook fittings.

The strap arrangements 60', 60" correspond to the connecting device 60 illustrated in FIG. 3, possibly with the exception of the deformation pattern of the piece of material between the end-parts of the connecting device fastened to the front piece.

It will be seen from FIG. 1 that the parts 125 of the front piece and therewith the associated coupling parts 70 extend in different radial directions to the associated post, depending on whether or not the upper edge portion 122 of the front piece has been folded down. Fitting and removal of the coupling part 70 to and from the post 80 is facilitated by virtue of the fact that said part 70 can be fitted to or removed from the post 80 regardless of its relative position of rotation around the post and regardless of which major body surface faces towards the root of the post.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A child-supporting shoulder harness for carrying a baby comprising a harness arrangement that includes chest straps and a front piece, said front piece being flexible at least in an upper portion thereof, and a lower portion of said front piece being connected to the lower part of the harness and connected at its laterally separated side edges with the chest straps such as to form a child-carrying pouch, a connecting device of selectively adjustable length having a first end-part and a second end-part that are connected to the front piece at positions that are mutually spaced laterally and that have a substantial mutual distance, said connecting device including a strap arrangement located at lateral end-parts of an upper edge portion of said front piece on an exterior side thereof when positioned for use, said connecting device further including an adjustment fitting with a pull strap that enables the effective distance between said two end-parts to be set selectively, said strap arrangement being configured such that shortening of said effective distance with said pull strap deforms said lateral end-parts of the upper edge portion of said front piece to reduce a wedging action between a wearer's chest and the baby's head and provide a comfortable lateral head support for said baby.

2. The child-supporting shoulder harness according to claim 1, wherein said pull strap extends through the adjustment fitting.

3. The child-supporting shoulder harness according to claim 1, wherein the lateral end-parts of the front piece have a fold line that extends generally vertically between the end-parts of the connecting device to facilitate said deforming of said lateral end-parts.

4. The child-supporting shoulder harness according to claim 1, wherein each of the lateral end-parts of the upper edge portion of the front piece can be connected to the adjacent chest strap through a respective coupling arrangement, said length-adjustable connecting device being fitted in connection with a coupling part of said coupling arrangement located on the front piece.

5. The child-supporting shoulder harness according to claim 1, wherein a releasable coupling arrangement connects said lateral end-part of said upper edge portion of the front piece to an adjacent part of the adjacent chest strap in a position above an attachment device that connects respective chest straps to an adjacent side edge of the front piece.

6. The child-supporting shoulder harness according to claim 5, wherein the connecting device is located at a central part of the front piece on the level of the attachment device.

7. The child-supporting shoulder harness according to claim 5, wherein said strap arrangement includes a strap connected to a lateral portion of the front piece at said attachment device.

8. The child-supporting shoulder harness according to claim 5, wherein the coupling arrangement includes two coupling parts of which a first coupling part is connected to the front piece and is connectable to its associated second coupling part in two positions of rotation about a generally horizontal axis in the plane of the front piece, said positions being mutually separated through 180°.

9. The child-supporting shoulder harness according to claim 8, wherein the upper edge portion of the front piece can be folded about a generally horizontal fold line, said first coupling part connected to the front piece being situated in a position in the proximity of the fold line in a flat-lain state of the front piece.

10. The child-supporting shoulder harness according to claim 9, wherein the first coupling part is located in the proximity of the generally horizontal fold line for the upper edge portion of the front piece.

11. The child-supporting shoulder harness according to claim 9, wherein the first coupling part connected to the front piece includes a ring-shaped body, said second coupling part co-acting with said first coupling part including a post which projects forwards essentially at right angles to the plane of the chest strap and has a latching waist, said ring-shaped body having latching elements which are spring-biased into engagement with mutually opposite sides of said waist when the coupling has been established, and said, ring-shaped body being able to be coupled to the post in both of said positions of rotation in which major surfaces of said ring-shaped body are parallel with the surface of the adjacent chest strap.

12. The child-supporting shoulder harness according to claim 11, wherein the free end of the post is conical so that it will function to move the latching element of the first coupling part as a result of the wedging effect obtained when threading the first coupling part onto the post, said latching elements carrying press keys which project out from the first coupling element in diametrically opposite directions so as to allow the latching elements to be moved out of their co-action with the waist on said post when the keys are subjected to pressure in mutually opposite directions.

13. The child-supporting shoulder harness according to claim 11, wherein the first coupling part is rotatable about its associated post.

14. A child-supporting shoulder harness to be worn by a wearer for carrying a baby comprising:

a harness arrangement that includes chest straps and a front piece, said front piece being flexible at least in an upper portion thereof, a lower portion of said front piece being connected to a lower part of the harness and connected at laterally separated side edges with the chest straps so as to form a child-carrying pouch;

a strap arrangement of selectively adjustable length located at lateral end-parts of an upper edge portion of said front piece on an exterior side thereof when said harness is in use, said strap arrangement including, a first end-part and a second end-part that are connected to the front piece at positions that are mutually spaced laterally from one another; and a pull strap connecting said end-parts that enables a distance between said end-parts to be set selectively, said first end-part being located nearer a center line of said front piece than said second end-part;

said lateral end-parts of the front piece having a first fold line and a second fold line spaced from one another and extending transversely to said pull strap, said first and second fold lines causing the lateral end-parts to bend thereon when said distance is shortened by reducing a length of said pull strap such that an outer portion of said lateral end-part between said second end-part and said fold line lies against the wearer's chest, and an inner portion of said lateral end-part between the first and second fold lines retains a generally flat state having an angle to the wearer's chest that varies with said pull strap length, said inner portion when angled away from the wearer's chest providing a comfortable lateral head support for the baby and reducing a wedging action between the wearer's chest and the baby's head.

15. The child-supporting shoulder harness according to claim 14, wherein a releasable coupling arrangement connects said lateral end-part of said upper edge portion of the front piece to an adjacent part of the adjacent chest strap in a position above an attachment device that connects respective chest straps to an adjacent side edge of the front piece.

16. The child-supporting shoulder harness according to claim 15, wherein the coupling arrangement includes two coupling parts of which a first coupling part is connected to the front piece and is connectable to its associated second coupling part in two positions of rotation about a generally horizontal axis in the plane of the front piece, said positions being mutually separated through 180°.

17. The child-supporting shoulder harness according to claim 16, wherein the upper edge portion of the front piece can be folded about a generally horizontal fold line, said first coupling part connected to the front piece being situated in a position in the proximity of the fold line in a flat-lain state of the front piece.

18. A child-supporting shoulder harness comprising:

a harness arrangement that includes chest straps and a front piece, said front piece being flexible at least in an upper portion, and a lower portion of said front piece being connected to the lower part of the harness and connected at its laterally separated side edges with the chest straps such as to form a child-carrying pouch;

a connecting device of selectively adjustable length having a first end-part and a second end-part that are connected to the front piece at positions that are mutually spaced laterally and that have a substantial mutual distance, said connecting device further including an adjustment fitting that enables the effective distance between said two end-parts to be set selectively;

a releasable coupling arrangement connecting said lateral end-part of said upper edge portion of the front piece to an adjacent part of the adjacent chest strap in a position above an attachment device that connects respective chest straps to an adjacent side edge of the front piece, said coupling arrangement including, a first coupling part connected to the front piece and including a ring-shaped body; and a second coupling part connectable to and coacting with said first coupling part, said second coupling part including a post which projects forwards essentially at right angles to the plane of the chest strap and has a latching waist, said ring-shaped body having latching elements which are spring-biased into engagement with mutually opposite sides of said waist when the coupling between the first and second coupling parts has been established.

19. The child-supporting shoulder harness according to claim 18, wherein first coupling part is connectable to said second coupling part in two positions of rotation about a generally horizontal axis in the plane of the front piece, said positions being mutually separated through 180°, said ring-shaped body being able to be coupled to said post in both of said positions of rotation in which major surfaces of said ring-shaped body are parallel with the surface of the adjacent chest strap.

20. The child-supporting shoulder harness according to claim 19, wherein the free end of the post is conical so that it will function to move the latching element of the first coupling part as a result of the wedging effect obtained when threading the first coupling part onto the post, said latching elements carrying press keys which project out from the first coupling element in diametrically opposite directions so as to allow the latching elements to be moved out of their co-action with the waist on said post when the keys are subjected to pressure in mutually opposite directions.

* * * * *